US005697721A

United States Patent [19]

von Rohrscheidt

[11] Patent Number: 5,697,721

[45] Date of Patent: Dec. 16, 1997

[54] INJECTION MOLDABLE SHEET BINDER

[76] Inventor: Friedrich von Rohrscheidt, 2210 Walhalla Dr., Richmond, Va. 22336

[21] Appl. No.: 657,762

[22] Filed: May 31, 1996

[51] Int. Cl.[6] ..... B42F 13/02

[52] U.S. Cl. ..... 402/19; 402/70; 402/73

[58] Field of Search ..... 402/19, 20, 26, 402/21, 70, 73, 75

[56] References Cited

U.S. PATENT DOCUMENTS

| | | | |
|---|---|---|---|
| 1,005,423 | 10/1911 | Elder . | |
| 2,170,260 | 8/1939 | Cruzan . | |
| 2,176,314 | 10/1939 | Russell . | |
| 2,202,097 | 5/1940 | Farkas . | |
| 2,234,401 | 3/1941 | Farkas et al. | 402/26 |
| 2,242,185 | 5/1941 | Spinner . | |
| 2,285,234 | 6/1942 | Tauber . | |
| 2,299,061 | 10/1942 | Spinner . | |
| 2,363,848 | 11/1944 | Emmer . | |
| 2,407,656 | 9/1946 | Emmer . | |
| 2,489,706 | 11/1949 | Emmer . | |
| 2,491,528 | 11/1949 | Spinner . | |
| 2,602,542 | 7/1952 | Spinner . | |
| 2,747,577 | 5/1956 | Freundlich . | |
| 2,891,552 | 6/1959 | Trussell . | |
| 2,935,986 | 5/1960 | Pluckebaum . | |
| 3,433,688 | 3/1969 | Staats et al. . | |
| 4,120,517 | 10/1978 | Staats et al. . | |
| 4,511,274 | 4/1985 | Chen | 402/19 X |
| 4,577,889 | 3/1986 | Schulz . | |
| 4,941,804 | 7/1990 | Sarpy, Jr. . | |
| 5,524,997 | 6/1996 | von Rohrscheidt . | |

FOREIGN PATENT DOCUMENTS

| | | |
|---|---|---|
| 1057565 | 3/1954 | France . |
| 635775 | 9/1936 | Germany . |
| 308584 | 10/1955 | Germany . |
| 1906028 | 12/1964 | Germany . |
| 1296604 | 6/1969 | Germany . |
| 2340129 | 2/1974 | Germany . |
| 2706371 | 9/1977 | Germany . |
| 431454 | 3/1967 | Switzerland . |
| 483709 | 4/1938 | United Kingdom . |
| 1436417 | 5/1976 | United Kingdom . |
| 1569497 | 6/1980 | United Kingdom . |

*Primary Examiner*—Willmon Fridie, Jr.

*Attorney, Agent, or Firm*—Jacobson, Price, Holman & Stern, PLLC

[57] ABSTRACT

A one piece injection molded binder for securing together a plurality of sheets having a longitudinally extending dorsal part and fingers spaced along the dorsal part. The binder is formed from a single piece of plastic material that is injection molded from a two-piece mold. No mold core parts are required. The binder includes an elongated dorsal part having a first longitudinally extending side and a second longitudinally extending side. A plurality of gaps or openings are spaced equidistantly along the perimeter between the first and second sides and a plurality of flexible fingers extend adjacent the gap opening, curved around to face the inside of the dorsal part perimeter adjacent the second side. The free ends of the fingers overlap the dorsal part.

14 Claims, 7 Drawing Sheets

A-A

B-B

DETAIL I

INJECTION MOLDABLE SHEET BINDER

BACKGROUND OF THE INVENTION

1. Field of the Invention

The present invention relates to a one-piece injection molded binder for securing together a plurality of sheets.

2. Description of Related Art

Conventional one-piece binders include a longitudinal dorsal part, free of gaps or openings, and fingers spaced along the dorsal part. The fingers form rings which run through punch holes in sheets of paper to secure the sheets together. The dorsal part and the rings are made of a single piece of flexible plastic. The fingers overlap the dorsal part, and are in contact with the dorsal part, so the sheets cannot slide and fall out of the rings.

The above-described binders are conventionally punched out of sheets of polyvinylchloride (PVC), then heated and rolled into a cylindrical shape. In the cutting process, approximately 15 percent of the initial sheet material is lost as surplus as a result of cutting the sheets into strips, punching the binders, and cutting the binders to length. PVC is the best suited material for the punching and rolling process, but it poses serious environmental issues since it creates hazardous gases when incinerated.

An improved injection-moldable one-piece binder for securing sheets of paper is described in applicant's U.S. patent application Ser. No. 08/342,048 filed Nov. 17, 1994 entitled Sheet Binder which is based upon, and claims priority from, German patent application No. P4434769.3 filed Sep. 29, 1994, by the same applicant and published on Apr. 4, 1996, having substantially the same disclosure. The preferred embodiments of the sheet binder described in applicant's prior application include a longitudinal dorsal part, free of gaps or openings, and a plurality of curved fingers spaced therealong whereby the end portions of the fingers do not overlap the dorsal part. As such, the binder can be effectively injection molded. As stated in applicant's prior application, if an overlap is provided, complicated and expensive injection molding tools are required.

The injection molding tools capable of producing the non-overlapping finger type of sheet binder of the applicant's above-referenced application include a mold arrangement including a core rod and two half molds that cooperate therewith about the core rod. After molding, the core rod must be longitudinally removed, in addition to the retracted movement of the two haft-molds. Removal of the core rod is undesirably time-consuming. In addition, there may be a tendency for the sheet binders to warp as the core rod is removed. Thus, there remains a need for a sheet binder design that is capable of being injection molded quickly and economically without the use of core rods in the mold or other complicated and expensive injection molding equipment.

SUMMARY OF THE INVENTION

The present invention overcomes the deficiencies of the above-described binders by providing a binder formed of a single piece of plastic material injection molded from a two-piece mold. The binder includes an elongated dorsal part having a first longitudinally-extending side and a second longitudinally-extending side. A plurality of fingers are formed integrally with, and extend from, the first side of the dorsal part. Each of the fingers has a free end which overlaps the dorsal part adjacent the second side. The fingers are curved to form rings with the dorsal part, which fingers are extendable through holes in paper sheets to secure the sheets to the binder. Each of the fingers have side edges that lie in planes angled toward each other at slight acute angles with respect to the longitudinal center line or major axis of the binder.

A plurality of gaps or openings are formed in and through the perimeter of the dorsal part spaced equidistantly along the length of the binder. The gaps extend about the perimeter, from a first gap-end edge adjacent the first side, and adjacent a finger, and end at a second gap end edge short of the second side of the dorsal part. In one embodiment, the first gap-end edge coincides with the first side of the dorsal part. The gap is further defined by a pair of gap side edges each of which lie in planes angled opposite to each other at slight obtuse angles with respect to the longitudinal center line or axis of the binder. The transverse distance across the ring binder between the first and second gap-end edges is not less than the distance between the second side of the dorsal part and the shortest distance across to the finger along a line parallel to the transverse distance between the first and second gap-end edges. This geometry enables the ring binder to be formed from a two-piece mold in a manner which will be apparent from the detailed description hereinbelow.

Advantageously, manufacturing the binder through injection molding results in a savings of material of approximately fifteen percent in comparison with the conventional punching process. All scrap material can be reused in the injection molding process.

Another advantage in manufacturing elastic binders by injection moldable plastic is the ability to produce the binders economically and to dispose of the binders in an environmentally sound way. Since plastic granulate is used as the basic material instead of plastic sheets, one manufacturing step, i.e., the step of producing the plastic sheets is eliminated. A plurality of types of injection moldable plastic is suitable, as long as the plastic remains flexible when cured.

The injection molded binder of the present invention can be made in many desired profiles, i.e., rectangular, circular, elliptical, or triangular. Thereby aesthetically appealing and unique profiles of the binder and the stack of paper can be achieved. By injection molding the binder, its profile can be chosen in a way that saves material.

Thus, it is an object of the present invention to provide a binder that may be quickly and economically molded from a two-piece mold assembly, and without the use of core rods.

It is further an object of the present invention to provide an aesthetically pleasing one-piece flexible, injection moldable binder having a plurality of fingers integral with and extending from a dorsal part of the binder wherein the fingers are curved, either arcuately or substantially rectangularly, so that their free ends may overlap the dorsal part within the interior perimeter of the dorsal part and ending just within the second side of the dorsal part. Still further, it is an object of the present invention to provide a flexible injection moldable sheet binder having a dorsal part and a plurality of fingers extending therefrom, wherein the dorsal part includes a plurality of gaps or openings adjacent each finger, and wherein all portions of the fingers, as observed when viewing them upwardly through the gap or opening, lie within the transverse distance across the gap or opening. This enables a two-piece mold assembly without a core rod.

These and other objects of the invention will be apparent from the following description of the invention making reference to the accompanying drawings.

DETAILED DESCRIPTION OF THE PREFERRED EMBODIMENTS

Figure 1:
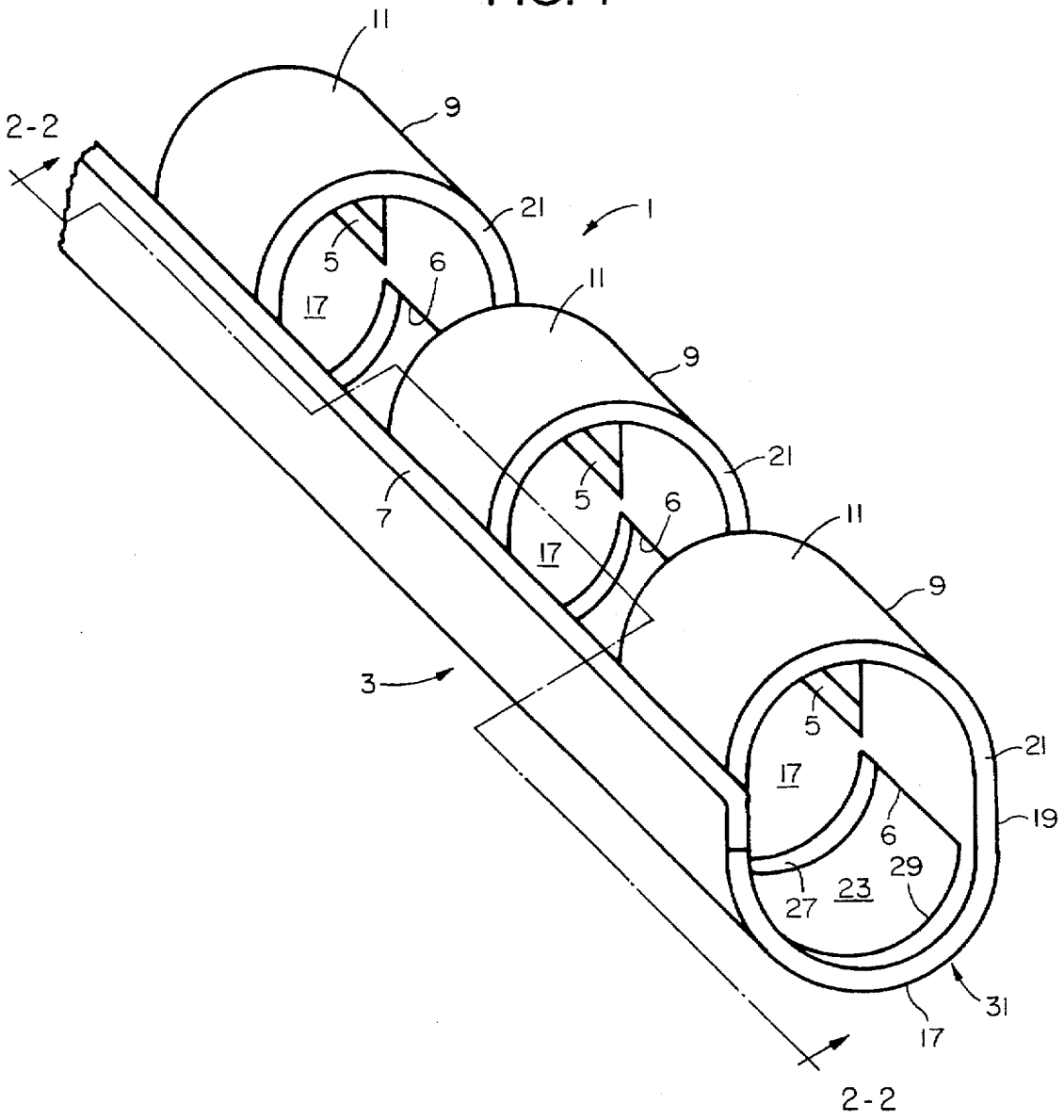
FIG. 1 is a perspective view of an end section of one embodiment of the sheet binder of the present invention showing three fingers of the binder.
Figure 2:
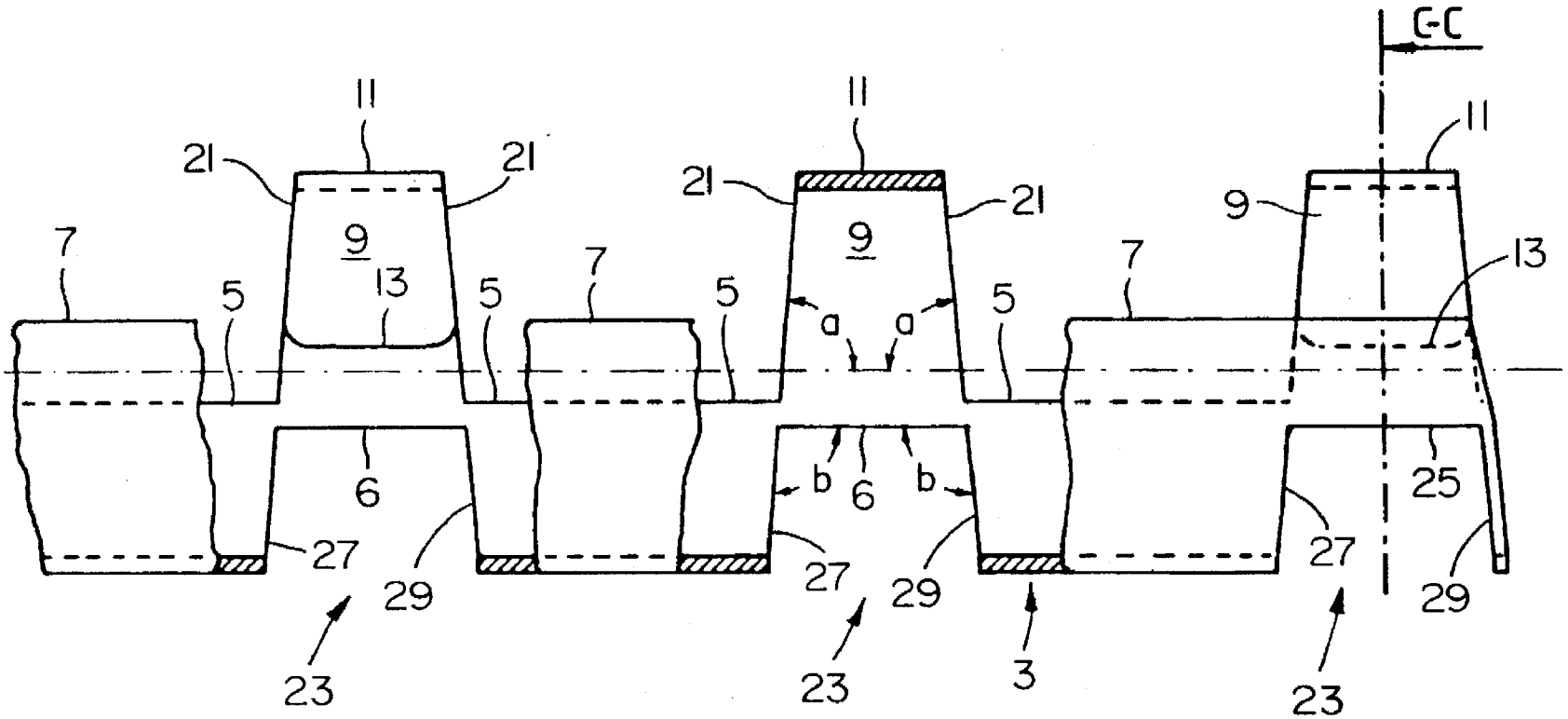
FIG. 2 is a view of the sheet binder of FIG. 1 along section line 2—2.

The sheet binder 1 of the present invention includes a longitudinally extending dorsal part 3 having a longitudinally extending first side 5 and a longitudinally extending second side 7. Integral with and extending from the first side are a plurality of flexible fingers 9 equidistantly spaced from each other along the full longitudinal length of the binder 1. In the embodiments of FIGS. 1 and 2, the fingers are curved substantially arcuately at their upper or topmost regions 11 having their free ends 13 overlapping the dorsal part 3 whereby the area adjacent the free ends 13 overlies, i.e. is just inside of the second side 7 of the dorsal part 3. The fingers 9 are flexible and freely movable with respect to the second side 7 of the dorsal part to enable sheets of paper, shown schematically as 15, to be inserted therein through the use of conventional sheet binding machines that are well known in the art, such as the GBC plastic binding system.

The dorsal part 3 has a perimeter (or peripheral) region 17 extending from and between the first longitudinally extending side 5 and the second longitudinally extending side 7. As shown in FIGS. 1 and 2, the fingers 9 are curved to be substantially arcuate at least at the region 11. The side region 19 of the fingers 9 and dorsal part 3 may be straight so that the overall perimeter of the dorsal part and fingers is substantially of a race-track configuration. The dorsal part 3 and the flexible fingers 9 form a ring to retain sheets of paper, as shown schematically in FIG. 3 and in the embodiment of FIG. 10.

As best shown in FIG. 2, each of the fingers 9 are slightly tapered whereby the width of the fingers 9 at their topmost point, i.e. at region 11, is less than the width of the fingers at their base, i.e., at the point that the fingers 9 meet the longitudinally-extending first side 5 of the dorsal part 3. Each of the fingers 9 has a side edge 21, each side edge 21 being curved in viewing the fingers 9 from an end of the binder 1 along the longitudinal axis of the binder. When viewing the binder fingers transverse to the longitudinal axis, as best shown in FIG. 2, the finger side edges 21 lie in planes which are slightly angled in directions facing each other at slight acute angles "a" with respect to the imaginary center line of the binder. That is, the side edge planes 21 of the fingers 9 deviate from right angles slightly so that the planes form angles with the center line of approximately 80°–85°, preferably 85°. Angles as low as 70° are also feasible. This slight angling enables the two-piece molding as will be apparent from the further description.

Disposed along the perimeter of the dorsal part, adjacent to each of the fingers, and equidistant from each other longitudinally, are a plurality of gaps or openings 23 extending about and through the periphery 17 of the dorsal part 3 from a first gap-end edge 6 of the dorsal part 3 around the perimeter to a second gap-end edge 25 which falls short of the second side 7 of the dorsal part 3. The gaps or openings 23 are further defined by a pair of gap side edges 27, 29 extending transversely about the periphery (or perimeter) 17 from the first gap-end edge 6 to the second gap-end edge 25. The second gap-end edge 25 is of the same length as the first gap-end edge 6 lying just below the first side 5 of the dorsal part. In looking at the binder along the length of the binder from an end region thereof, it can be seen that preferably the gap is arcuate, at least at the bottommost region 31, and the two end edges of the gap (at 6 and 25) are at approximately 180° from each other. The length of each of gap-end edge, in a longitudinal direction as best shown in FIG. 2, is slightly greater than the length of the base of the flexible fingers 9 where the fingers meet the first side 5.

The gap side edges 27, 29 lie in planes that are angled slightly in directions away from each other forming slightly obtuse angles "b" with respect to the center line of the binder. In this embodiment, the gap side edge planes 27, 29 are coplanar with the side edge planes 21 of the fingers 9. Thus, the gap side edge angles "b" are approximately 95°–100°, preferably 95°. Angles as high as 110° are also feasible.

Figure 3:
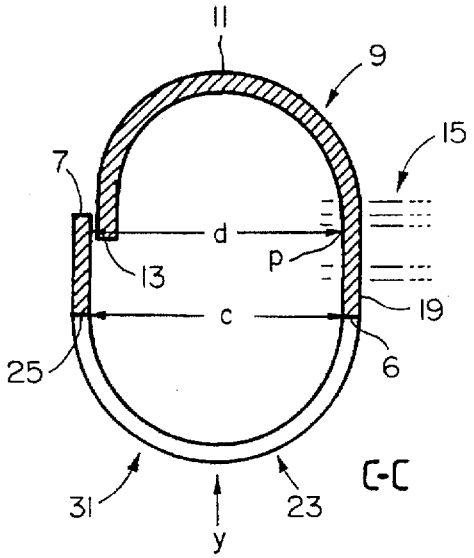
FIG. 3 is a transverse cross-sectional view along section line C—C of FIG. 2
Figure 4:
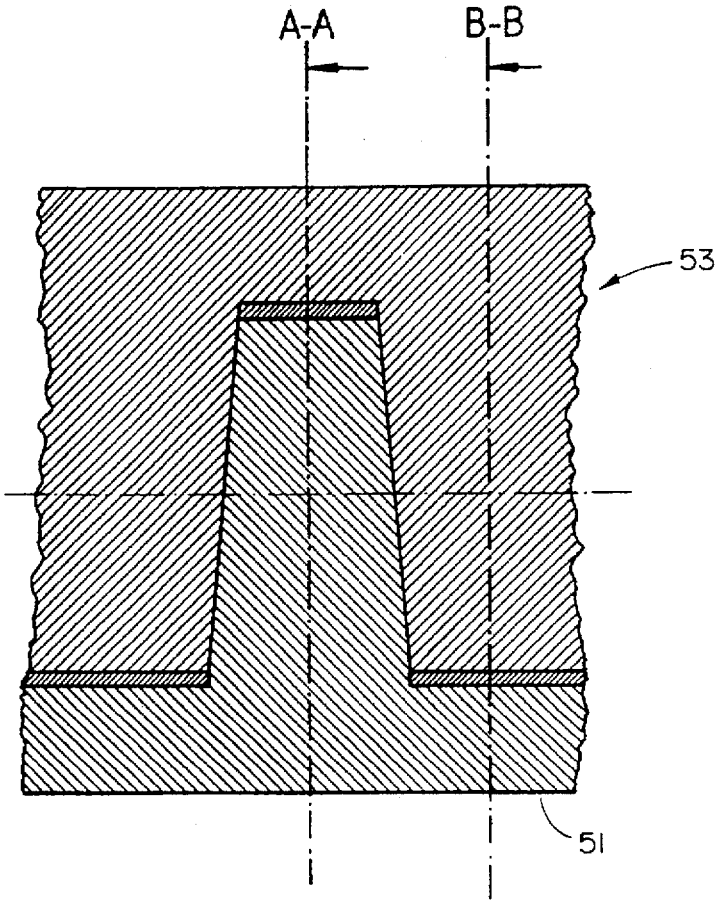
FIG. 4 is a partial cross-sectional view of a two-piece mold for molding a binder of FIG. 1 showing the molding of a single finger, a gap, and the adjacent dorsal part peripheries, along a plane through the longitudinal axis of the binder corresponding to the view of the central finger of FIG. 2.
Figure 5:
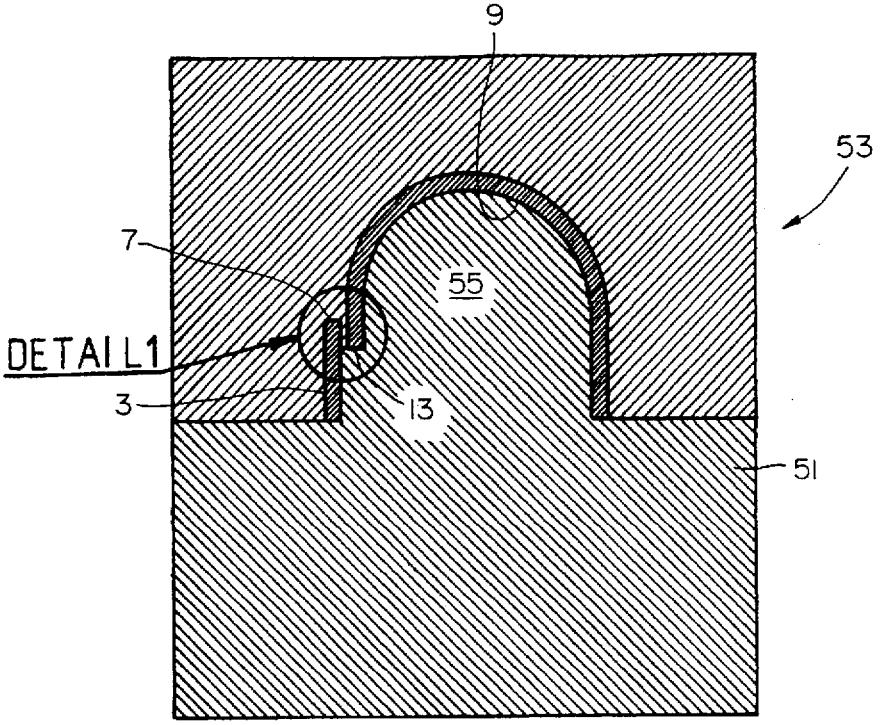
FIG. 5 is a cross-sectional view of a two-piece mold showing the upper part of the binder, taken along section line A—A of FIG. 4.
Figure 6:
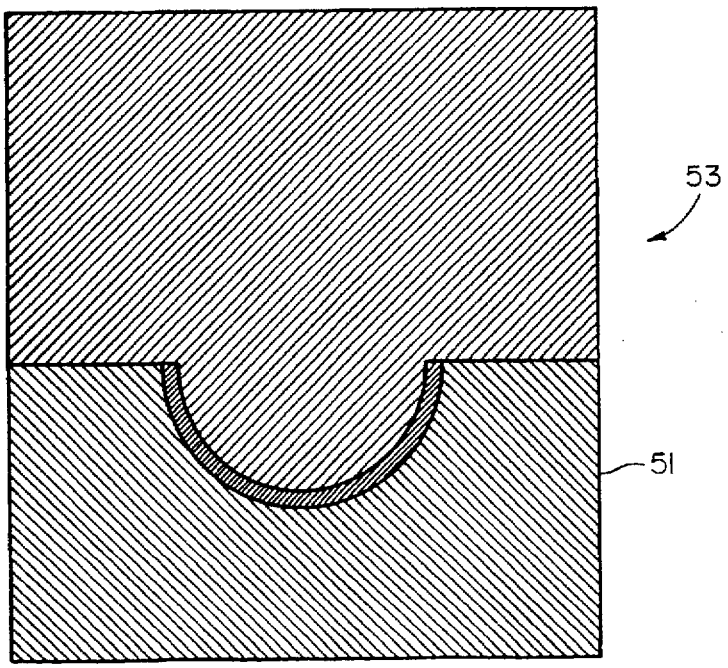
FIG. 6 is a cross-sectional view of a two-piece mold showing the bottom part of a binder, taken along section line B—B of FIG. 4.
Figure 7:
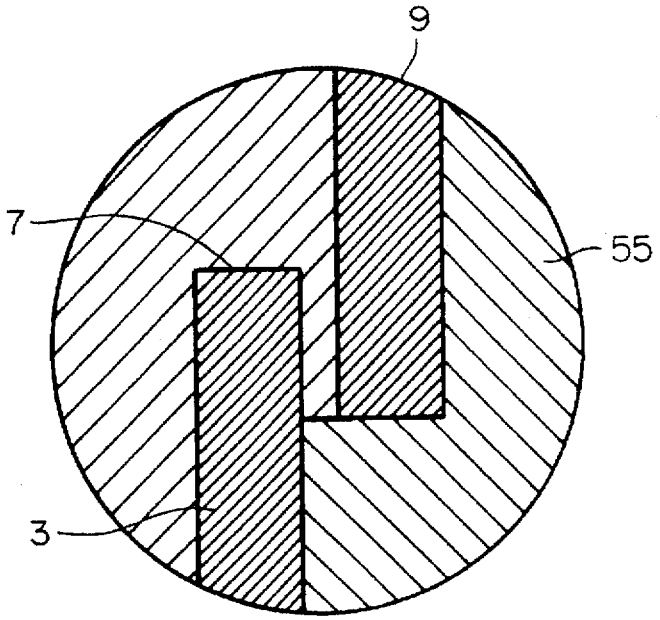
FIG. 7 is an expanded view of a two-piece mold at the overlap of the finger with the dorsal part, as shown as Detail 1 in FIG. 5.

As best shown in FIG. 3, the transverse length between the inside of the second gap-end edge 25 and the first gap-end edge 6 of the dorsal part 3 which transverse length has been designated "c", must not be less than the parallel transverse distance "d" between the inside of the second side 7 and the finger 9, at the shortest distance thereacross, designated point "p" in FIG. 3. This is required so that a lower half 51 of a two-piece mold 53, as best shown in FIG. 5, which includes a protrusion 55, may extend straight upward to define or form the curved finger 9. Note that there is a gap or spacing defined by the mold of FIG. 5 as best shown in FIG. 7 whereby the curved finger 9 may be formed adjacent a side portion of the dorsal part 3 near its second side 7. After the molding process is completed and the plastics material cooled, this gap may remain although, depending upon the speed of cooling of the binder and other molding factors, there may be some expansion whereby the fingers 9 end up in contact with the dorsal part 3 near second side 7, after curing is completed. FIG. 4 shows a cross-section of the mold viewed along a center line plane of the binder. FIGS. 5 and 6 show transverse cross-sectional views at planes perpendicular to the longitudinal axis of the binder at section lines A—A and B—B. It should be apparent that, in order to mold a sheet or ring binder with a two-piece mold, having no core rod, the sheet binder must be configured so that all portions of the fingers 9, as observed when looking upward through the gap 23 along line "y" as shown in FIG. 3, lie within the transverse distance "c". In this regard, it should be apparent that the free ends 13 of the fingers may end above the second side 7, so that there is no overlap with the side of the dorsal part 3, but the free end 13 cannot extend radially outward to overlie the top edge of the second side 7.

Preferably polypropylene is used as the ring binding material. However, many suitable injection moldable plastics can be used, including PVC. Indeed, any plastics material capable of being molded to produce a flexible binder can be utilized.

Figure 10:
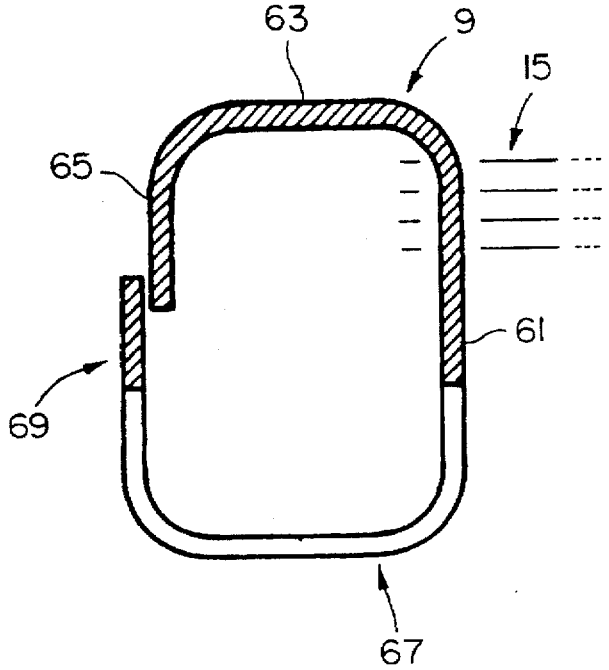
FIG. 10 is a transverse cross-sectional view of an alternative form of sheet binder.

The binder can be produced in other profiles, such as a square, round, elliptical or even having a somewhat triangularly angled finger. An example of a substantially rectangular ring binder shown in a cross-sectional view similar to FIG. 3, is depicted in FIG. 10. The curved fingers 9 include three legs 61, 63, 65 at substantially right angles with respect to each other. Sheets of paper 15 are shown schematically which sheets can extend from leg 61 of the fingers. This results in a stack of sheets with a square edge. The gap or opening 67 defined in the dorsal part 69 has a profile, when looking along the longitudinal center line, of edges that are substantially at right angles with respect to each other.

Figure 8:
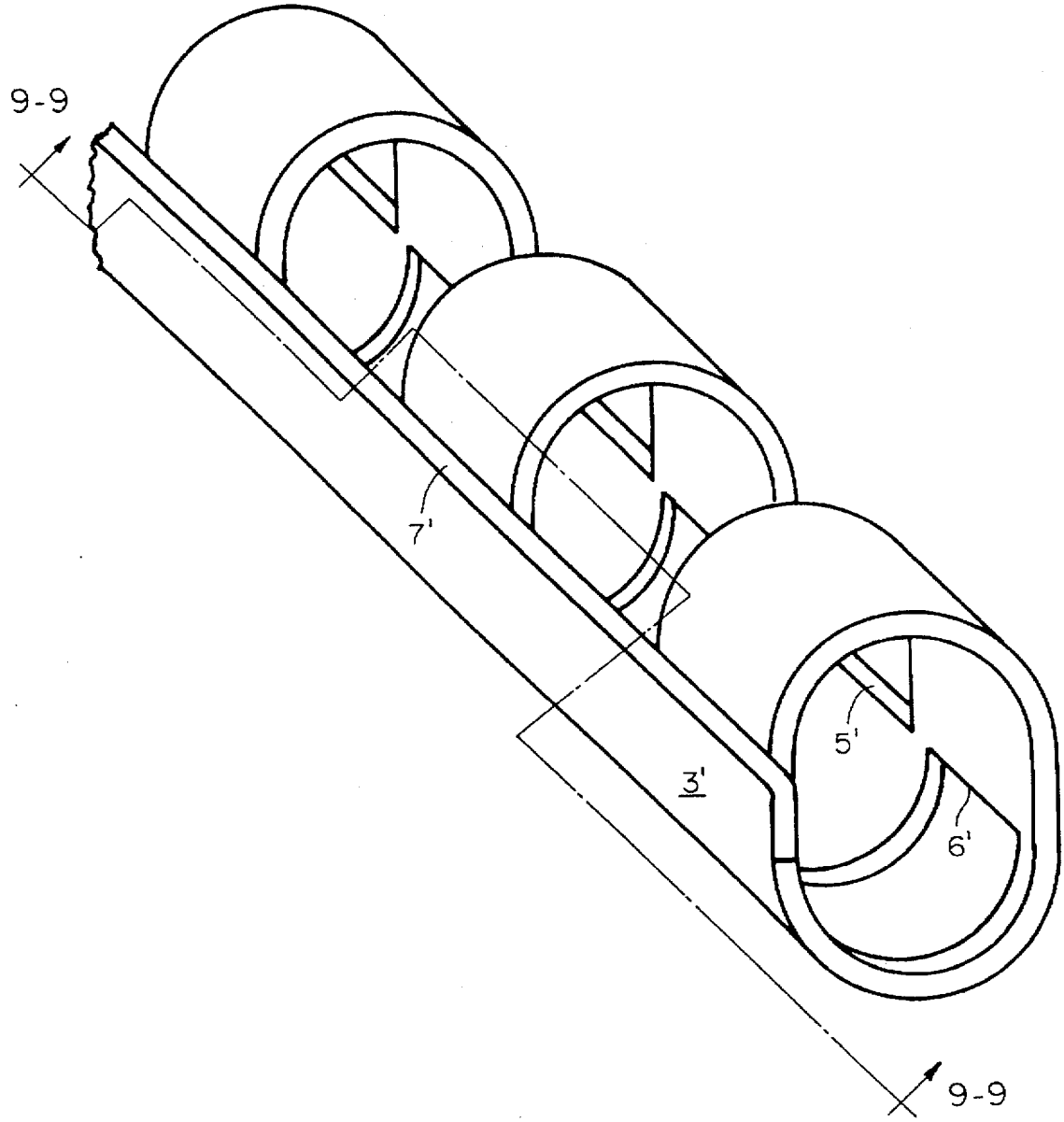
FIG. 8 is a perspective view of an end section of an alternate embodiment of the sheet binder of the present invention showing three fingers of the binder.
Figure 9:
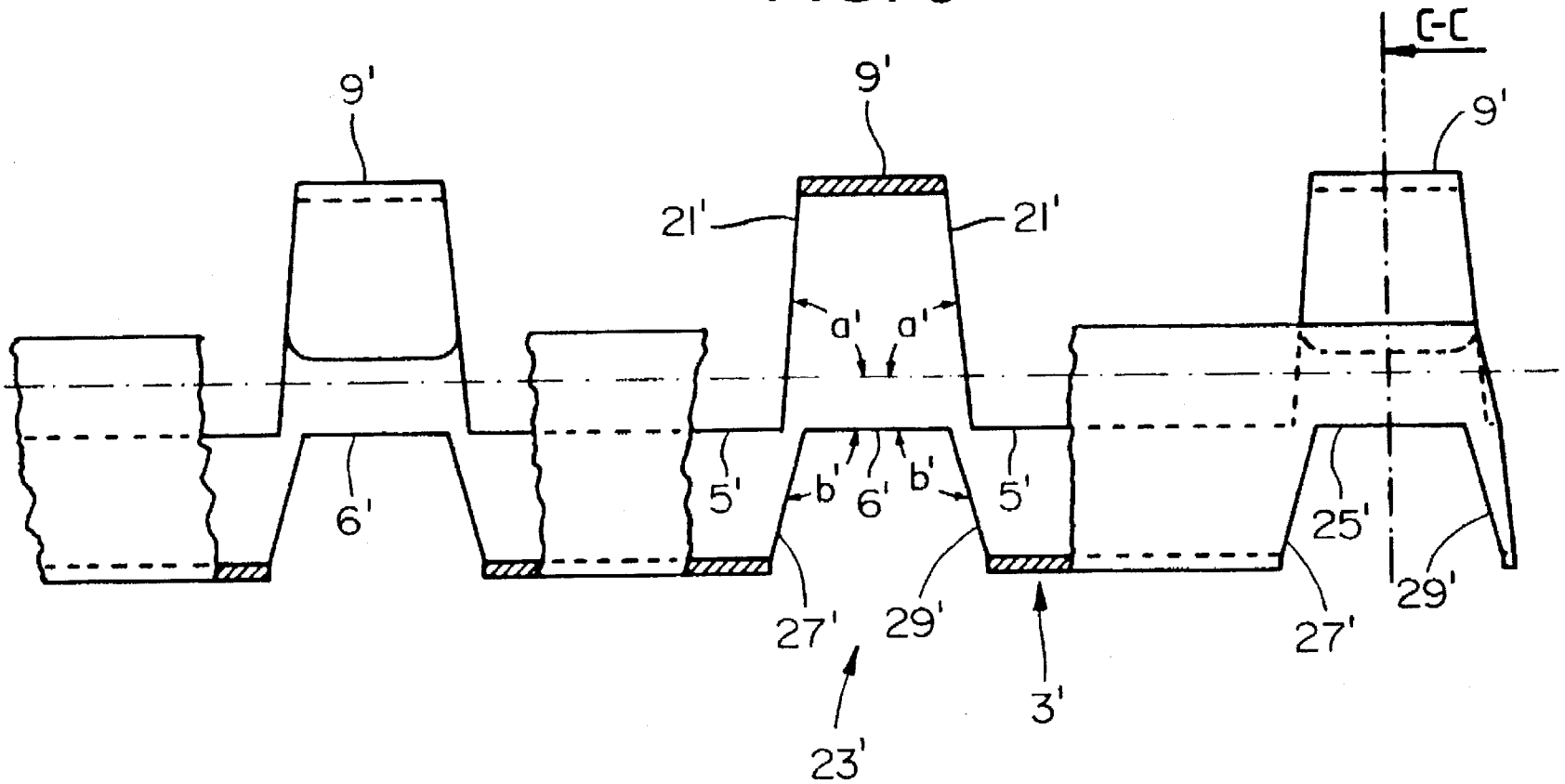
FIG. 9 is a view of the sheet binder of FIG. 8 along section line 9—9.

FIGS. 8 and 9 depict an alternative injection moldable binder in views corresponding to FIGS. 1 and 2. Only the differences between the two binders will be described, it being apparent that otherwise the overall binder geometry is the same. Both binders are injection moldable from a two-piece mold without the use of core rods. The cross-sectional view along C'—C' will look the same as FIG. 3. The mold views of FIGS. 4–6 will also be the same.

As best shown in FIG. 9, the first gap-end edge 6' is collinear with the first side 5' of the dorsal part 3'. The length along the longitudinal axis of the first gap-end edge 6' is less than the length of the base of the fingers 9', where the fingers join with the first side 5'. The finger side edges 21' are angled (angle a') the same as in the embodiment of FIGS. 1 and 2 and form planes of 80°–85°, preferably 85°, with respect to the longitudinal axis. The gap side edges 27', 29' are at slightly greater angles (angle b') than coplanarity with the planes 21. If, for example, angle a' is 85°, angle b' may be preferably 105°. Angle a' may be as low as approximately 70°. Angle b' may be as great as approximately 120°.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. An elongated binder for securing a stack of sheets, said binder having a longitudinally extending central axis, comprising:

an elongated dorsal part having a longitudinally-extending first side and a longitudinally-extending second side defining a perimeter region therebetween, said dorsal part including a plurality of gaps equidistantly spaced longitudinally, each gap extending transversely from a longitudinally extending first gap-end edge, about the perimeter region, and ending at a longitudinally extending second gap-end edge short of said second side;

a plurality of flexible fingers formed integrally with and extending from the first side of the dorsal part, each of the fingers adjacent said gap, each of the fingers having a free end and having opposite finger side edges that lie in planes inclined toward each other at slightly acute angles with respect to said central axis, wherein the fingers are curved with their free ends overlying said dorsal part adjacent the second side and within the interior perimeter region of said dorsal part, said fingers resiliently movable with respect to the second side of said dorsal part and insertable through holes in sheets to secure the sheets on the binder, said fingers and said dorsal part forming a plurality of rings.

2. The elongated binder as claimed in claim 1 wherein each of said gaps are defined by a pair of gap side edges that lie in planes inclined away from each other at slightly obtuse angles with respect to said central axis.

3. The elongated binder as claimed in claim 1, wherein the transverse length of the gap between said first gap-end edge and said second gap-end edge is not less than the shortest transverse distance across the interior of the ring between said second side and said flexible finger lying adjacent the gap.

4. The elongated binder as claimed in claim 1, wherein the binder is formed of an injection moldable plastic material which remains flexible when cured.

5. The elongated binder as claimed in claim 4, wherein the plastic material is polypropylene.

6. The elongated binder as claimed in claim 4, wherein the binder is formed by a two-piece mold having no core rod.

7. The elongated binder as claimed in claim 1, wherein the rings have a non-circular shape.

8. The elongated binder as claimed in claim 7, wherein the non-circularly shaped rings are flattened on a side extending through the holes of the sheets such that the sheets in the binder form a stack with a square edge.

9. The elongated binder as claimed in claim 1, wherein the curved fingers have three legs substantially at right angles with respect to each other.

10. The elongated binder as claimed in claim 1, wherein the curved fingers are substantially arcuately shaped.

11. The elongated binder as claimed in claim 1, wherein said dorsal part has a substantially curved perimeter region.

12. The elongated binder as claimed in claim 2, wherein each of the pair of gap side edges are arcuate.

13. The elongated binder as claimed in claim 1, wherein said first gap-end edge is substantially collinear with said first side of the dorsal part.

14. The elongated binder as claimed in claim 2, wherein said finger side edges lie in planes coplanar with the planes defined by said gap side edges.

* * * * *